US009727003B2

(12) United States Patent
Yoshida et al.

(10) Patent No.: US 9,727,003 B2
(45) Date of Patent: Aug. 8, 2017

(54) IMAGE FORMING APPARATUS WITH A POWER SUPPLY APPLYING CHARGED VOLTAGE TO A CHARGING SECTION

(71) Applicant: Konica Minolta, Inc., Chiyoda-ku, Tokyo (JP)

(72) Inventors: Eri Yoshida, Toyokawa (JP); Junji Murauchi, Toyokawa (JP)

(73) Assignee: Konica Minolta, Inc., Chiyoda-ku, Tokyo (JP)

( * ) Notice: Subject to any disclaimer, the term of this patent is extended or adjusted under 35 U.S.C. 154(b) by 0 days.

(21) Appl. No.: 15/080,303

(22) Filed: Mar. 24, 2016

(65) Prior Publication Data

US 2016/0282748 A1 Sep. 29, 2016

(30) Foreign Application Priority Data

Mar. 26, 2015 (JP) ..... 2015-064096

(51) Int. Cl.
*G03G 15/02* (2006.01)

(52) U.S. Cl.
CPC ..... *G03G 15/0283* (2013.01); *G03G 15/0266* (2013.01)

(58) Field of Classification Search
CPC ..... G03G 15/0266; G03G 15/0283
USPC ..... 399/50; 361/225
See application file for complete search history.

(56) References Cited

U.S. PATENT DOCUMENTS

| | | | | |
|---|---|---|---|---|
| 8,180,236 | B2 * | 5/2012 | Hanashi | G03G 15/0266 399/50 X |
| 2001/0019669 | A1 | 9/2001 | Watanabe et al. | |
| 2007/0059000 | A1 * | 3/2007 | Shibuya | G03G 15/0266 399/50 X |
| 2010/0111550 | A1 * | 5/2010 | Kubo | G03G 15/0283 399/50 |
| 2011/0110677 | A1 * | 5/2011 | Uehara | G03G 15/0266 399/50 |

FOREIGN PATENT DOCUMENTS

JP 2001-201920 A 7/2001

* cited by examiner

*Primary Examiner* — Sophia S Chen
(74) *Attorney, Agent, or Firm* — Buchanan Ingersoll & Rooney PC

(57) ABSTRACT

A power supply applies a first charged voltage to a charging section disposed near an image carrier during a predetermined process and applies second charged voltages sequentially to the charging section in obtaining a predetermined peak-to-peak voltage value for an alternating-current voltage of the first charged voltage. Each of the second charged voltages includes an alternating-current voltage having a peak-to-peak voltage value varying between a forward discharge range and a back discharge range. A current sensing section senses the alternating-current running through the charging section upon application of each of the second charged voltages. A control section derives a first approximation function and a second approximation function on the basis of the alternating-current values sensed by the current sensing section and sets a peak-to-peak voltage value as the predetermined peak-to-peak voltage through a difference function representing a difference value between the first approximation function and the second approximation function.

8 Claims, 11 Drawing Sheets

S215

S215

IMAGE FORMING APPARATUS WITH A POWER SUPPLY APPLYING CHARGED VOLTAGE TO A CHARGING SECTION

This application is based on Japanese Patent Application No. 2015-064096 filed on Mar. 26, 2015, the content of which is incorporated herein by reference.

BACKGROUND OF THE INVENTION

1. Field of the Invention

The present invention relates to an image forming apparatus provided with a charging section employing a proximity electrification system and receiving a charged voltage which includes a direct-current voltage and an alternating-current voltage superimposed thereon.

2. Description of Related Art

In recent years, in view of, for example, ozone depletion, the proximity electrification system is becoming a mainstream charging system for image forming apparatuses. In the case of the proximity electrification system, a charging section in the form of, for example, a roller, a brush, or a blade is disposed in proximity to and either in or out of contact with the surface of a photoreceptor drum, which is a typical example of an image carrier.

In a predetermined process such as a printing process, the charging section receives a charged voltage which includes a direct-current voltage and an alternating-current voltage superimposed thereon and having a predetermined peak-to-peak voltage value Vpp1, so that the surface of the image carrier is uniformly charged (see, for example, Japanese Laid-Open Patent Publication No. 2001-201920).

In Japanese Laid-Open Patent Publication No. 2001-201920, to allow stable discharge between the charging section and the image carrier, the charging section is sequentially provided by a power supply with alternating-current voltages having different detection peak-to-peak voltage values Vpp0 both in a forward discharge range, where only a charge transfer from the charging section to the image carrier occurs (i.e., unidirectional charge transfer), and in a back discharge range, where a bidirectional charge transfer between the charging section and the image carrier occurs in an alternating manner. For the forward discharge range and the back discharge range, a control section derives approximation functions f1(Vpp) and f2(Vpp) of alternating-current value Iac to peak-to-peak voltage value Vpp, and thereafter, derives the predetermined peak-to-peak voltage value Vpp1 and a discharge current amount ΔIac, the difference function (ΔIac (=f2(Vpp)−f1(Vpp)) of which takes a predetermined value D.

In Japanese Laid-Open Patent Publication No. 2001-201920, the predetermined value D is constant regardless of the degree of wear and tear on the image carrier due to repeated printing and other factors. However, the inventors of the present invention found out through experimentation that an optimal predetermined value D varies depending on the degree of wear and tear. More specifically, the optimal predetermined value D decreases as wear and tear progresses. Accordingly, the peak-to-peak voltage value Vpp1, which is optimal at the initial stage of the life of the image carrier, is unnecessarily high (i.e., not optimal) at the last stage of life, so that the image carrier is damaged significantly. As a result, wear and tear is accelerated, so that the life of the image carrier becomes shorter than designed.

SUMMARY OF THE INVENTION

An embodiment of the present invention is directed to an image forming apparatus for printing an image on a medium being fed therethrough, including: an image carrier; a charging section disposed in proximity to the image carrier; a power supply applying a first charged voltage to the charging section during a predetermined process and also applying a plurality of second charged voltages sequentially to the charging section in obtaining a predetermined peak-to-peak voltage value, wherein the first charged voltage includes an alternating-current voltage having the predetermined peak-to-peak voltage value, each of the second charged voltages includes an alternating-current voltage, and the alternating-current voltage of the second charged voltage has a peak-to-peak voltage value varying between a forward discharge range where a charge transfer occurs only from the charging section to the image carrier and a back discharge range where a bidirectional charge transfer occurs between the image carrier and the charging section; a current sensing section sensing a value of the alternating-current running through the charging section upon application of each of the second charged voltages; and a control section deriving a first approximation function and a second approximation function on the basis of the alternating-current values sensed by the current sensing section and setting a peak-to-peak voltage value as the predetermined peak-to-peak voltage through a difference function representing a difference value between the derived first approximation function and the derived second approximation function, wherein the first approximation function and the second approximation function represent alternating-current values relative to peak-to-peak voltage values in the forward discharge range and the back discharge range, and the peak-to-peak voltage value being set as the predetermined peak-to-peak voltage is a value for which an amount of change of the difference value per unit peak-to-peak voltage in the difference function takes a predetermined value.

DETAILED DESCRIPTION OF THE PREFERRED EMBODIMENTS

Hereinafter, an image forming apparatus according to an embodiment of the present invention will be described with reference to the drawings.

Section 1: Definitions

Some figures show x-, y'-, and z-axes perpendicular to one another. The x- and z-axes respectively represent the right-left direction and the top-bottom direction of the image forming apparatus 1. The y'-axis represents the front-back direction of the image forming apparatus 1.

Figure 1:
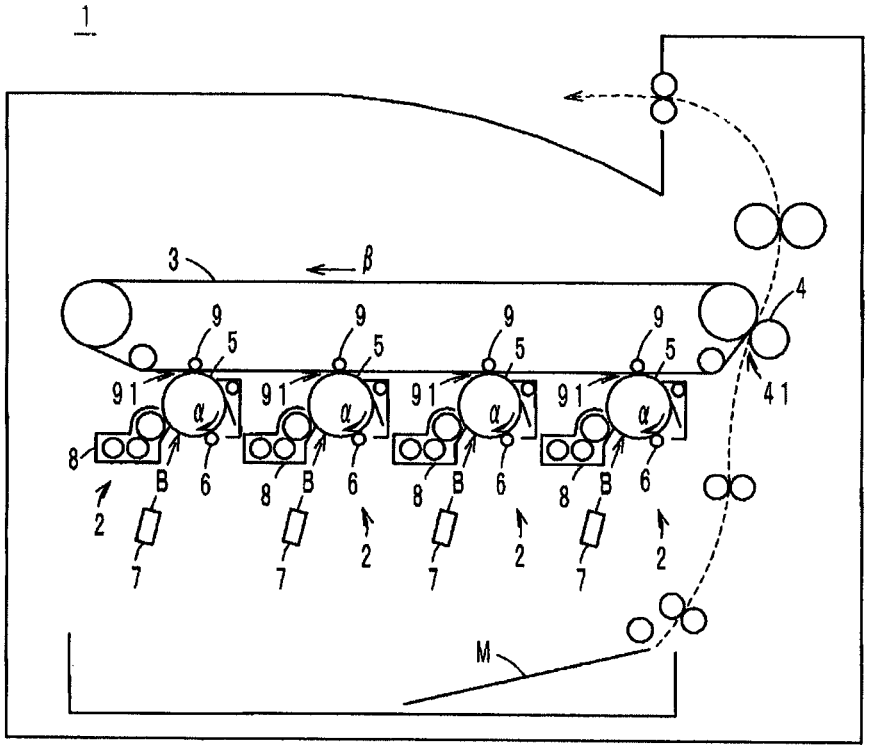
FIG. 1 is a schematic view illustrating the general configuration of an image forming apparatus.
Figure 1:
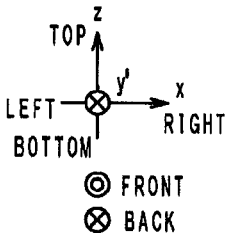

Section 2: General Configuration and Print Operation of Image Forming Apparatus According to Embodiment In FIGS. 1 and 2, the image forming apparatus 1 is, for example, a copier, printer, or fax machine, or a multifunction machine provided with all or some of the functions, and is adapted to print a variety of types of images (typically, full-color or monochrome images) on sheets of print media M (e.g., paper or overhead projector (OHP) sheets) using a tandem system with a well-known electrophotography technology. To this end, the image forming apparatus 1 typically includes imaging units 2 for the colors yellow (Y), magenta (M), cyan (C), and black (K), an intermediate transfer belt 3, a secondary transfer roller 4, a power supply 10, a control section 11, a current sensing section 12, and a temperature and humidity sensing section 13.

For example, the imaging units 2 for the four colors are arranged side by side in the right-left direction and include respective photoreceptor drums 5 for their corresponding colors.

Each photoreceptor drum 5 is in the shape of, for example, a cylinder extending in the front-back direction, and rotates about its own axis, for example, in the direction of arrow α.

Arranged around the photoreceptor drum 5 as above, from upstream to downstream in the rotational direction α, are, at least, a charging section 6, a developing section 8, and a primary transfer roller 9. Note that FIG. 2 shows only one representative photoreceptor drum 5 for a certain color and its vicinity.

The charging section 6 is typically a charging roller extending in the front-back direction and being disposed in proximity to and either in or out of contact with the photoreceptor drum 5. The charging section 6 charges the circumferential surface of the photoreceptor drum 5 with a charged voltage Vg while the photoreceptor drum 5 is rotating.

Figure 2:
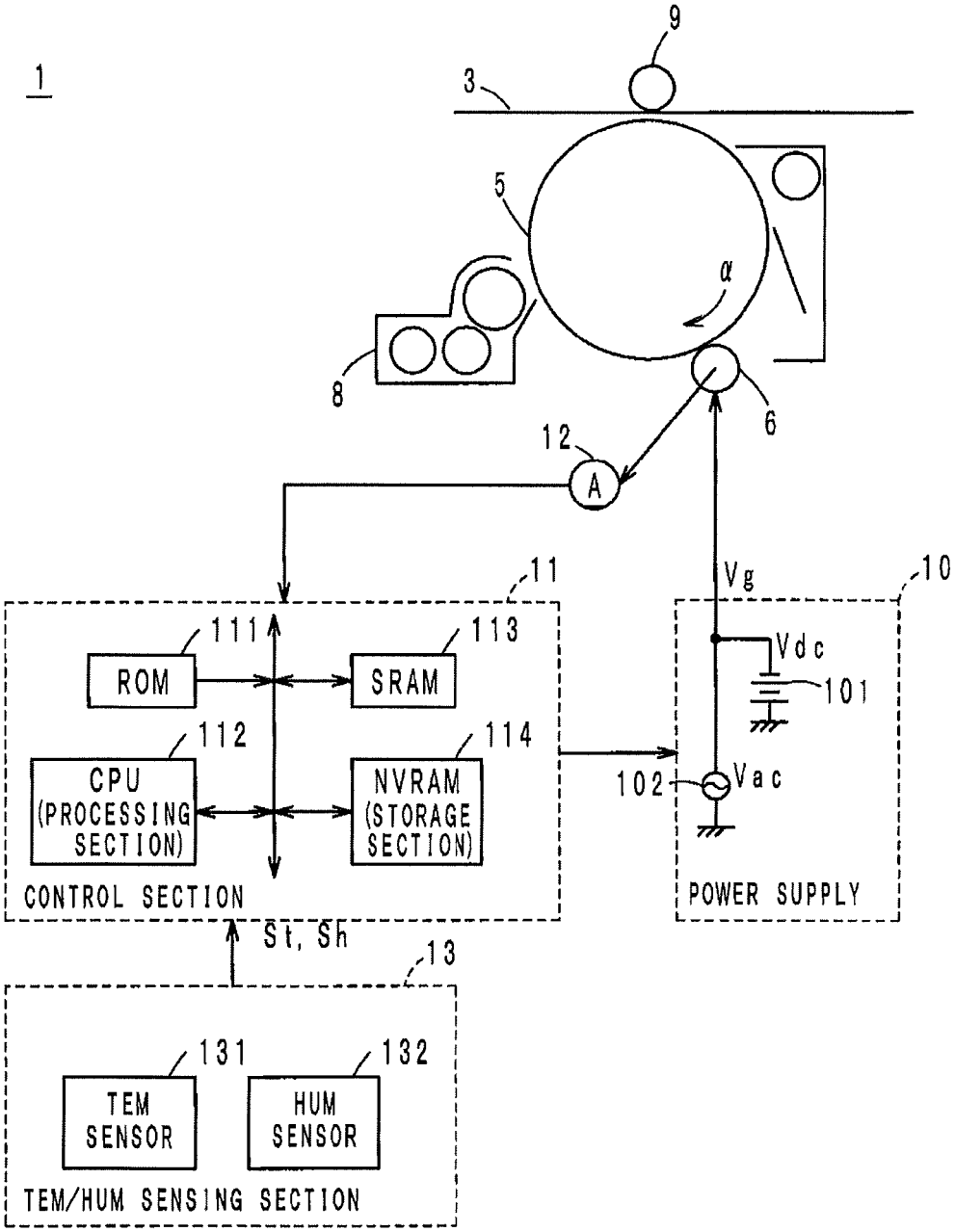
FIG. 2 is a schematic diagram illustrating essential parts of an image forming apparatus according to an embodiment.

The image forming apparatus 1 includes a power supply 10, which, for example, is provided for each color, i.e., for each charging section 6, in order to apply the charged voltage Vg to the charging section 6, as explicitly shown in FIG. 2. The power supply 10 includes a combination of a direct-current power circuit 101 and an alternating-current power circuit 102. Note that FIG. 2 shows only one power supply 10 for a certain color as a representative example.

The direct-current power circuit 101, under control of the control section 11, outputs a predetermined direct-current voltage Vdc. Note that the present embodiment does not put importance on changing the direct-current voltage Vdc for each color, and therefore, for the sake of clarity, the direct-current voltage Vdc will be described below as being the same among the colors.

Furthermore, the alternating-current power circuit 102 is, for example, an alternating-current transformer, and outputs an alternating-current voltage Vac having a peak-to-peak voltage value Vpp selected or decided by the control section 11. Note that as in the case of the direct-current voltage Vdc, the alternating-current voltage Vac will be described below as having the same peak-to-peak voltage value Vpp among the colors.

The alternating-current power circuit 102 is connected at an output terminal to an output terminal of its corresponding direct-current power circuit 101, so that the charged voltage Vg, which includes the direct-current voltage Vdc and the alternating-current voltage Vac superimposed thereon, is generated and applied to the charging section 6 for the corresponding color.

Provided below the photoreceptor drum 5 is an exposing device 7. The exposing device 7 irradiates an exposure area of the photoreceptor drum 5, which is immediately downstream from a charged area of the photoreceptor drum 5, with an optical beam B based on image data, thereby forming an electrostatic latent image in the corresponding color.

The developing section 8 supplies a developer for the corresponding color to a developing area of the photoreceptor drum 5, which is immediately downstream from the exposure area, thereby forming a toner image in the corresponding color in the developing area.

The intermediate transfer belt 3 is stretched between outer circumferential surfaces of at least two rollers arranged, for example, in the right-left direction and rotates, for example, in the direction of arrow β. The outer circumferential surface of the intermediate transfer belt 3 abuts, for example, the upper end of each photoreceptor drum 5.

The primary transfer roller 9 is positioned opposite to the photoreceptor drum 5 with the intermediate transfer belt 3 positioned therebetween, and presses the inner circumferential surface of the intermediate transfer belt 3 from above, thereby forming a primary transfer nip 91 between the photoreceptor drum 5 and the intermediate transfer belt 3. During a printing process, the primary transfer roller 9 receives a primary transfer bias voltage, so that the toner image on the photoreceptor drum 5 is transferred onto the intermediate transfer belt 3 at the primary transfer nip 91 while the intermediate transfer belt 3 is rotating.

The secondary transfer roller 4 is rotatable about its own axis. During a printing process, the secondary transfer roller 4 receives a secondary transfer bias voltage. The secondary transfer roller 4 is positioned, for example, near the right end of the intermediate transfer belt 3 so as to press the outer circumferential surface of the intermediate transfer belt 3, forming a secondary transfer nip 41 at the contact between the secondary transfer roller 4 and the intermediate transfer belt 3. During the printing process, the secondary transfer nip 41 receives an incoming print medium M.

The secondary transfer roller 4 is receiving the secondary transfer bias voltage while the print medium M is passing through the secondary transfer nip 41 (i.e., during the feeding of the sheet), so that the toner image carried on the intermediate transfer belt 3 is transferred onto the print medium M. The print medium M passes through the secondary transfer nip 41 and a fuser of a well-known type, and thereafter is ejected into a tray as a print.

The control section 11 includes, for example, a ROM 111, a CPU 112, which is an example of a processing section, an SRAM 113, and an NVRAM 114, which is an example of a storage section, as explicitly shown in FIG. 2. The CPU 112 executes a control program pre-stored in the ROM 111 using the SRAM 113 as a workspace, thereby controlling various processes. In the present embodiment, the following four processes are particularly relevant: printing, image stabilization, forced toner replenishment, and toner-to-carrier ratio (TCR) adjustment). These four processes require charging of the photoreceptor drum 5, and therefore, a charged voltage Vg, including an alternating-current voltage Vac having a predetermined peak-to-peak voltage value Vpp1, (referred to below as a first charged voltage Vg1) is applied to the charging section 6.

More specifically, the aforementioned four processes are:

(1) printing: to print an image on a printing medium M;

(2) image stabilization: to control toner density to be a target value in accordance with the density of a known pattern image;

(3) forced toner replenishment: to forcedly replenish the developing section with toner; and (4) TCR adjustment: to control the toner-to-carrier ratio to be a target value.

In addition, the CPU 112 further performs a "predetermined peak-to-peak voltage value derivation process (to be described in detail later)", thereby deriving a predetermined peak-to-peak voltage value Vpp1 to be used in the aforementioned processes.

Furthermore, at least in the predetermined peak-to-peak voltage value derivation process, the current sensing section 12 senses the value Iac of an alternating current running through the charging section 6 via the photoreceptor drum 5 upon application of a charged voltage Vg2, which will be described later, to the charging section 6, and the current sensing section 12 outputs the alternating-current value Iac to the CPU 112.

The temperature and humidity sensing section 13 includes a temperature sensor 131 and a humidity sensor 132. The temperature sensor 131 senses a temperature St inside the image forming apparatus 1 (referred to below as an internal temperature St), and outputs the internal temperature St to the CPU 112. On the other hand, the humidity sensor 132 senses relative humidity Sh inside the image forming apparatus 1 (referred to below as internal humidity Sh), and outputs the internal humidity Sh to the CPU 112.

Section 3: Procedure for Deciding Charged Voltage (Including Predetermined Peak-to-Peak Voltage Value Derivation Process)

Figure 3A:
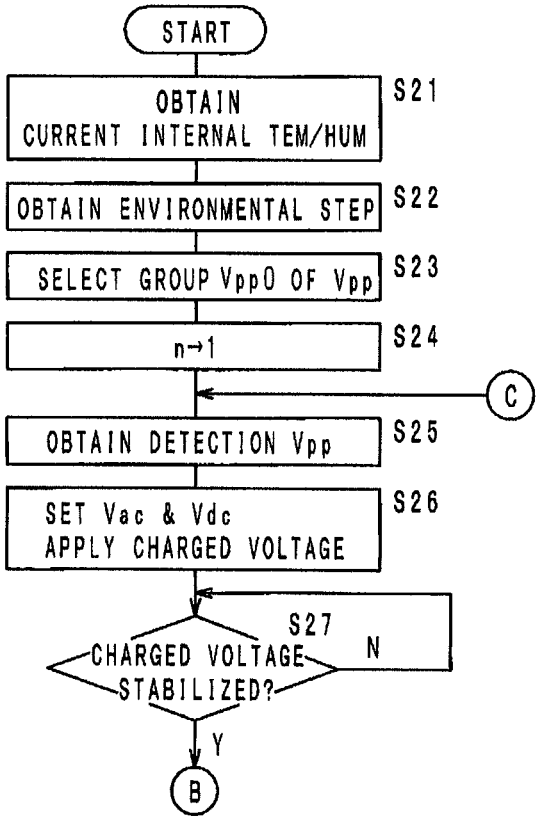
FIG. 3A is a flowchart showing a portion of the procedure for deciding a peak-to-peak voltage value.

Next, the operation of the image forming apparatus 1 will be described with reference to FIGS. 3A to 7. In FIG. 3A, to decide a peak-to-peak voltage for the aforementioned four processes, the CPU 112 obtains the current internal temperature St and the current internal humidity Sh from the temperature and humidity sensing section 13 in the image forming apparatus 1 with no printing medium M being fed, i.e., in non-paper feeding state, (S21).

Next, the CPU 112 obtains an environmental step corresponding to the internal temperature St and the internal humidity Sh obtained at S21, from an environmental-step table T1 pre-stored in the ROM 111 or the NVRAM 114 (S22). The table T1 lists an environmental step, which is an index of the magnitude of absolute humidity, for each combination of an internal temperature and internal humidity, as shown in TABLE 1 below. The table T1 is generated in advance through experimentation or suchlike in the course of the manufacture or development of the image forming apparatus 1. The same can be said of other tables. The present embodiment employs 16 environmental steps; environmental steps 1 to 3 represent low-temperature/low-humidity environments (i.e., L/L environments), environmental steps 4 to 7 represent normal-temperature/normal-humidity environments (i.e., N/N environments), environmental steps 8 to 12 represent environments with slightly higher temperatures and humidity than the N/N environments, and environmental steps 13 to 16 represent high-temperature/high-humidity environments (i.e., H/H environments).

TABLE 1

TABLE 1: Environmental Step Table T1

| | | Internal Temperature (° C.) | | | | | | |
|---|---|---|---|---|---|---|---|---|
| | | <15 | <20 | <24 | <28 | <32 | <44 | 44≥ |
| Internal | <18 | 1 | 1 | 1 | 2 | 2 | 2 | 2 |
| Humidity | <32 | 2 | 2 | 2 | 2 | 3 | 4 | 6 |
| (%) | <55 | 3 | 5 | 5 | 7 | 7 | 8 | 9 |
| | <65 | 4 | 5 | 7 | 7 | 8 | 9 | 10 |
| | <75 | 6 | 6 | 7 | 8 | 9 | 10 | 11 |
| | <85 | 8 | 8 | 9 | 9 | 11 | 12 | 14 |
| | 85≥ | 10 | 11 | 12 | 13 | 14 | 15 | 16 |

Next, the CPU 112 selects a group of peak-to-peak voltage values Vpp (referred to below as detection peak-to-peak voltages Vpp0) corresponding to the environmental step obtained at S22, from a peak-to-peak voltage value table T2 pre-stored in the NVRAM 114 or suchlike (S23). The table T2 lists a group of different detection peak-to-peak voltage values Vpp0 (in the present embodiment, eight different values) for each range of environmental steps, as shown in TABLE 2 below. Each group includes at least two detection peak-to-peak voltage values Vpp0 (in the present embodiment, four values) for each of the forward discharge range and the back discharge range. In the present embodiment, the forward discharge range is a range where the peak-to-peak voltage value Vpp is less than 2×Vth (see FIG. 5), as will be described later, and only a charge transfer from the charging section 6 to the photoreceptor drum 5 occurs (i.e., unidirectional charge transfer) when the charged voltage Vg is applied to the charging section 6. In contrast, the back discharge range is a range where the peak-to-peak voltage value Vpp is greater than or equal to 2×Vth (see FIG. 5), and a bidirectional charge transfer between the photoreceptor drum 5 and the charging section 6 occurs when the charged voltage Vg is applied to the charging section 6. Here, Vth is a voltage at which the photoreceptor drum 5 starts to be charged.

For example, the group of detection peak-to-peak voltage values Vpp0 assigned to the environmental steps 1 to 3 is group A consisting of 600 V, 700 V, 800 V, and 900 V within the forward discharge range as well as 1850 V, 1950 V, 2050 V, and 2150 V within the back discharge range. The groups of detection peak-to-peak voltage values Vpp0 assigned to the environmental steps 4 to 7, 8 to 12, and 13 to 16 are groups B, C, and D, respectively, as shown in TABLE 2.

TABLE 2

TABLE 2: Peak-to-Peak Voltage Table T2

| | | Environmental Step | | | |
|---|---|---|---|---|---|
| | n | 1-3 Group A | 4-7 Group B | 8-12 Group C | 13-16 Group D |
| Group of Detection Peak-to-Peak Voltage Values | 1 | 1000 | 1000 | 1000 | 1000 |
| | 2 | 1100 | 1100 | 1100 | 1100 |
| | 3 | 1200 | 1200 | 1200 | 1200 |
| | 4 | 1300 | 1300 | 1300 | 1300 |
| | 5 | 2000 | 1950 | 1900 | 1850 |
| | 6 | 2100 | 2050 | 2000 | 1950 |
| | 7 | 2200 | 2150 | 2100 | 2050 |
| | 8 | 2300 | 2250 | 2200 | 2150 |

Next, the CPU 112 initializes a first counter value n to 1 (S24), and obtains a detection peak-to-peak voltage value Vpp0 corresponding to the current first counter value n from the group selected at S23 (S25).

The CPU 112 sets the peak-to-peak voltage value Vpp of an alternating-current voltage Vac to be outputted by each alternating-current power circuit 102 to the detection peak-to-peak voltage value Vpp0 obtained at S25. Moreover, the CPU 112 sets a direct-current voltage Vdc to be outputted by each direct-current power circuit 101 to a predetermined value (S26).

As a result of step S26, the power supply 10 applies the second charged voltage Vg2 to each charging section 6. After the alternating-current voltage Vac of each alternating-current power circuit 102 stabilizes (S27), the CPU 112 initializes a second counter value m to 1 (S28 in FIG. 3B). Then, the CPU 112 obtains an alternating-current value Iac from each current sensing section 12, and stores the obtained alternating-current value Iac in the SRAM 113 for each color (S29).

Next, the CPU 112 determines whether the second counter value m is y (S210). Here, y is the sampling number per rotation of each photoreceptor drum 5, represented by a natural number greater than or equal to 1. If the determination at S210 is "N", the CPU 112 increments the second counter value m by 1 (S211), and performs the processing of S29.

By repeating the above steps S28 to S211, the SRAM 113 holds alternating-current values Iac measured at y different points in the circumferential direction for each photoreceptor drum 5 while the photoreceptor drum 5 makes one rotation. If the determination at S210 is "Y", the CPU 112 derives an average of the y alternating-current values Iac, and stores the average in the SRAM 113 (S212).

In the present embodiment, to smoothen variations in thickness of the surface layer of each photoreceptor drum 5, it is preferable that by steps S28 to S212, the CPU 112 takes an average of the y alternating-current values Iac measured at different points in the circumferential direction while the photoreceptor drum 5 makes one rotation.

Next, the CPU 112 determines whether the first counter value n is 8, thereby determining whether all detection peak-to-peak voltage values Vpp0 in the group selected at S23 have already been subjected to the processing of steps S25 to S212 (S213). If the determination at S213 is "N", the CPU 112 increments the first counter value n by 1 (S214), and performs step S25 in FIG. 3A.

Through the above steps S25 to S214, the SRAM 113 receives eight values Iac (averages), four each of the forward discharge range and the back discharge range, of an alternating current running through each charging section 6 upon sequential application of second charged voltages Vg2 to each charging section 6. The CPU 112 causes the SRAM 113 to hold eight combinations of the detection peak-to-peak voltage value Vpp0 used at S26 and the alternating-current value Iac (average) obtained at S212 for each color. The combinations of the detection peak-to-peak voltage value Vpp0 and the alternating-current value Iac held in the SRAM 113 will be referred to below simply as the combinations (Vpp0, Iac) without distinction. However, in the case where the values of n from 1 to 8 are to be distinguished from one another, the combinations will be specified as (Vpp0j, Iacj) where j is a natural number from 1 to 8.

Furthermore, if the determination at S213 is "Y", the CPU 112 derives a predetermined peak-to-peak voltage value Vpp1 in accordance with the combination (Vpp0, Iac) for each color (S215).

Figure 4:
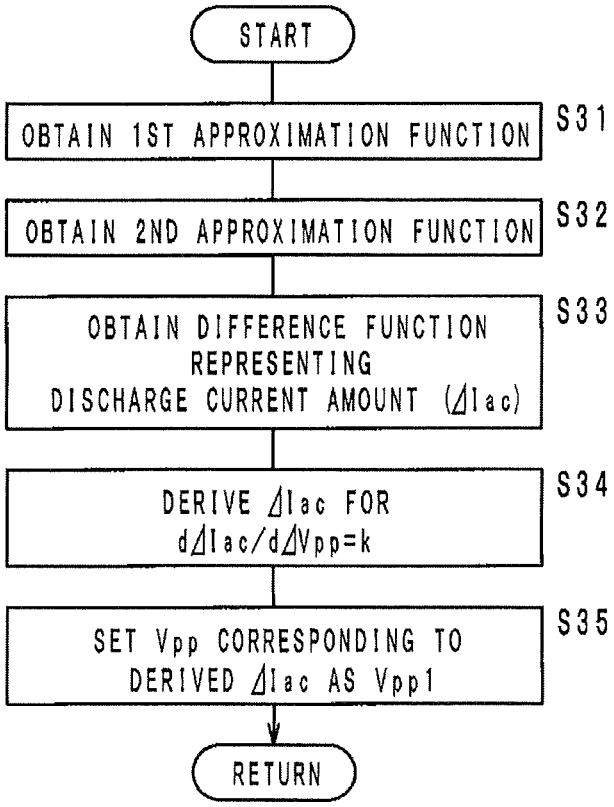
FIG. 4 is a flowchart showing in detail the processing of S215 in FIG. 3B.

The peak-to-peak voltage value derivation process will now be described in detail with reference to FIGS. 4 and 5. In FIG. 4, the CPU 112 initially selects four combinations (Vpp, Iac) within the forward discharge range for each color, and performs linear approximation of these four sets of data, for example, by least squares. As a result, the CPU 112 obtains line L1, i.e., first approximation function Iac=f1 (Vpp) where Vpp<2×Vth (see the upper panel of FIG. 5), for approximation of the characteristic of the alternating-current value Iac over the peak-to-peak voltage value Vpp (referred to below as the Vpp-Iac characteristic) within the forward discharge range (S31).

Next, the CPU 112 performs curve approximation of the four combinations (Vpp, Iac) within the back discharge range for each color, thereby obtaining curve L2, i.e., second approximation function Iac=f2(Vpp) where 2×Vth Vpp (see the upper panel of FIG. 5), for approximation of the Vpp-Iac characteristic within the back discharge range (S32). Note that the reason for the curve approximation at S32 is that the actual Vpp-Iac characteristic within the back discharge range is similar to a curve rather than a straight line.

Next, the CPU 112 derives a function of approximating the discharge current amount ΔIac over the peak-to-peak voltage value Vpp (S33). In a specific example, the derived function is a difference function, f2(Vpp)−f1(Vpp), to subtract the first approximation function from the second approximation function, representing the difference value ΔIac.

Figure 5:
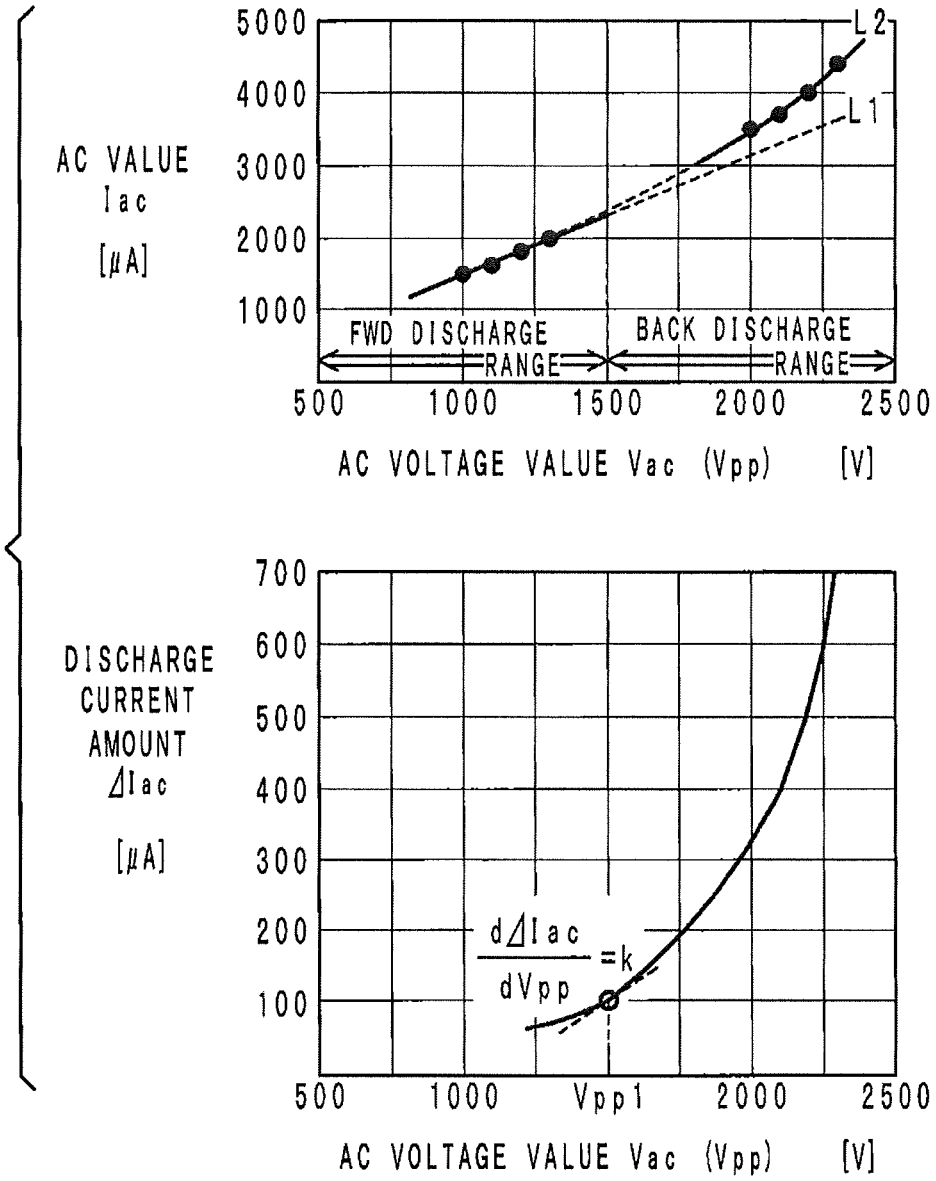
FIG. 5 is a diagram specifically describing the content of the procedure in FIG. 4.
Figure 6:
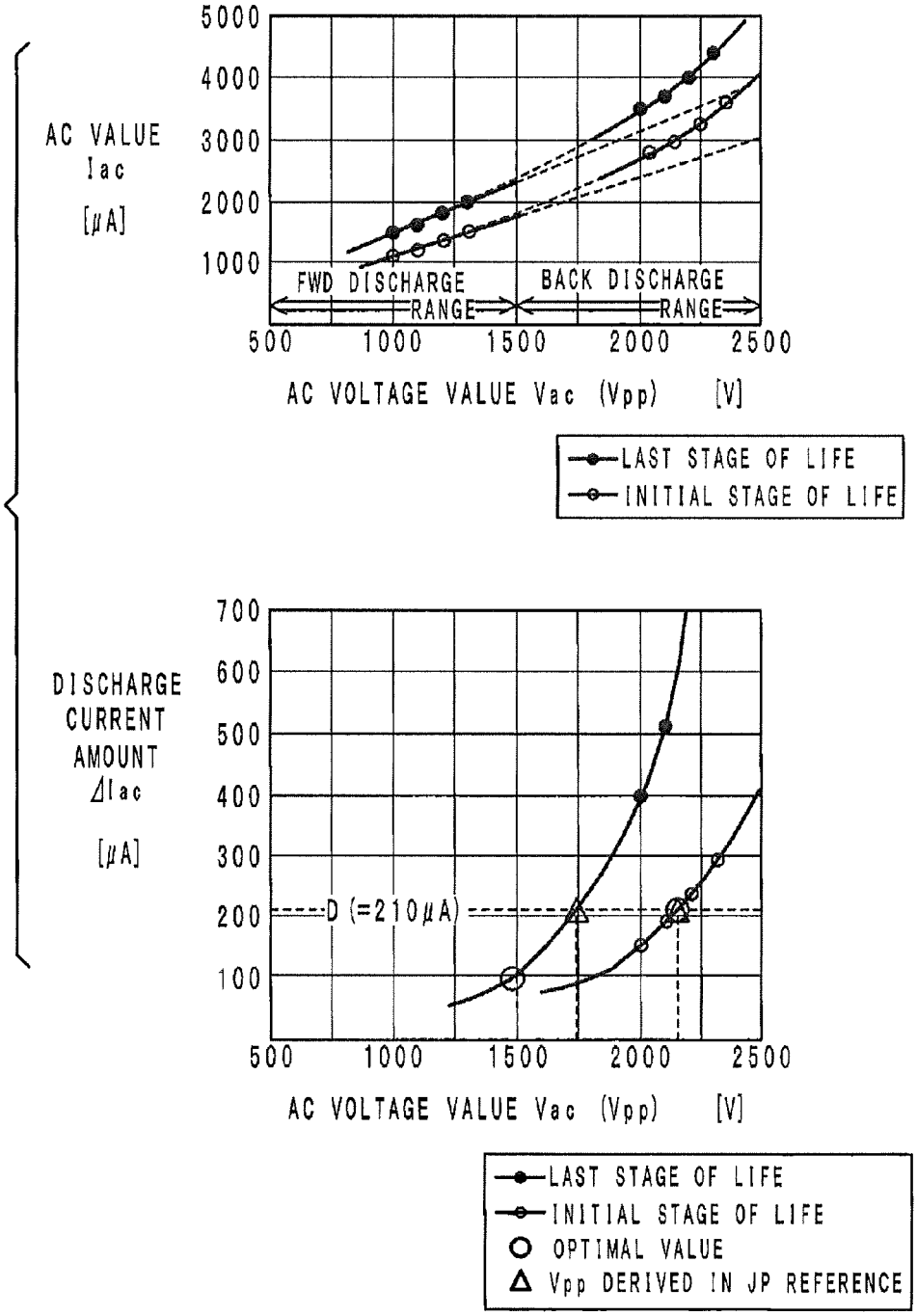
FIG. 6 provides graphs showing the difference between current values sensed by a current sensing section depending on the life of a photoreceptor drum (upper panel) and the difference between optimal peak-to-peak voltage values depending on the life of the photoreceptor drum (lower panel)

Next, the CPU 112 derives a discharge current amount ΔIac by a difference function where the amount of change of the difference value (discharge current amount) ΔIac per unit peak-to-peak voltage, i.e., the derivative dΔIac/dVpp, takes a predetermined value k (S34), as shown in the lower panel of FIG. 5. Note that in the present embodiment, the amount of change of the discharge current amount ΔIac is an increment. Thereafter, the CPU 112 derives a predetermined peak-to-peak voltage value Vpp1, which is a peak-to-peak voltage value Vpp corresponding to the derived discharge current amount ΔIac, by the difference function ΔIac (S35).

Here, the predetermined value k is constant regardless of the number of printed pages, and is defined in advance, for example, in the course of the design and development of the image forming apparatus 1, as in the following manner. In trial runs of the apparatus with unused photoreceptor drums 5, printing processes are performed using charged voltages Vg, which include superimposed alternating-current voltages Vac having various peak-to-peak voltage values Vpp. Other conditions are the same among the trial runs. In the trial runs, Vpp−ΔIac characteristic curves are initially measured. Moreover, the image quality of prints obtained by the trial runs and damage to the photoreceptor drums 5 are inspected, for example, visually, and a peak-to-peak voltage value Vpp that significantly reduces damage to the photoreceptor drums 5 is selected as an optimum. The predetermined value k is defined as the slope of a tangent to the Vpp−ΔIac characteristic curve at a peak-to-peak voltage value Vpp that achieves high image quality, i.e., the slope being the amount of change of the difference value (discharge current amount) ΔIac per unit peak-to-peak voltage; the predetermined value k falls within the range of from approximately 1/5 to approximately 1/4.

Figure 3B:
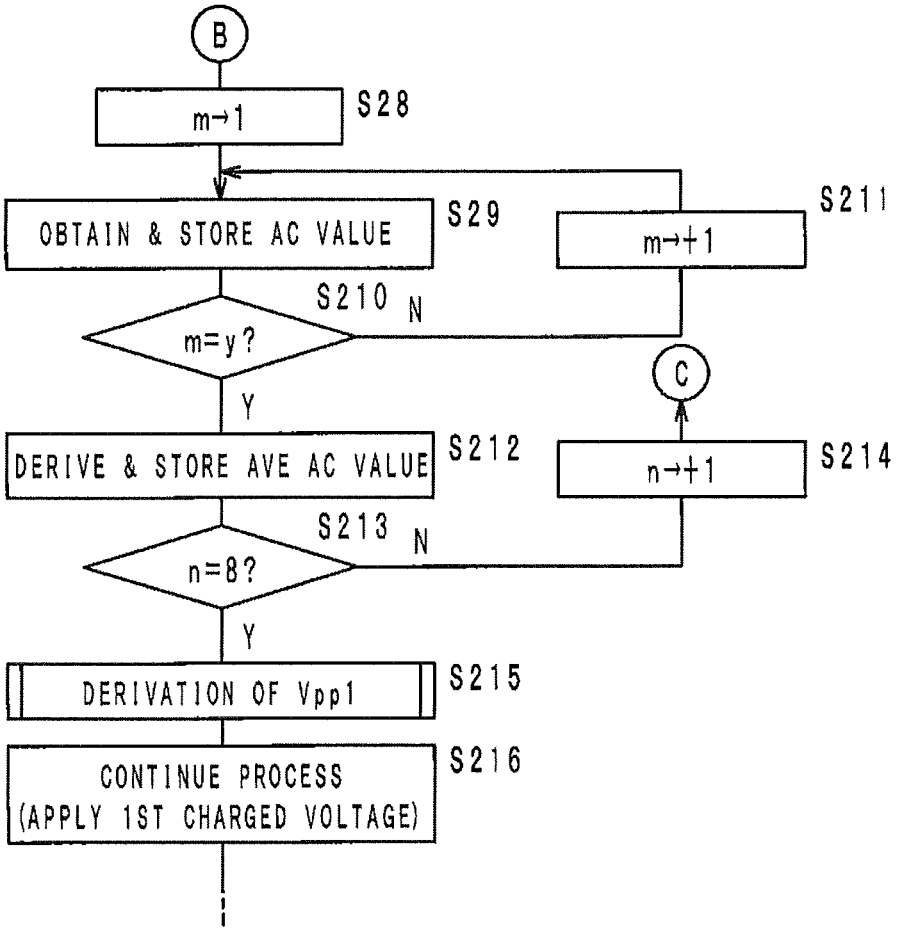
FIG. 3B is a flowchart showing the rest of the procedure continued from FIG. 3A.

Upon completion of S34, the CPU 112 ends the processing in FIG. 4 (i.e., S215 in FIG. 3B), and performs step S216 in FIG. 3B. More specifically, the CPU 112 sets the peak-to-peak voltage value Vpp for the alternating-current voltage Vac to be outputted by each alternating-current power circuit 102, to the predetermined peak-to-peak voltage value Vpp1 derived at S215, and also sets the direct-current voltage Vdc to be outputted by each direct-current power circuit 101, to a predetermined value. As a result, the power supply 10 applies the first charged voltage Vg1 to each charging section 6, so that each photoreceptor drum 5 is charged (S216).

Section 4: Actions and Effects of Image Forming Apparatus

In general, the surface layer of the photoreceptor drum is worn by repeated printing, and decreases in thickness as the number of printed pages increases. Accordingly, the resistance of the photoreceptor drum is relatively low at the last stage of the life of the photoreceptor drum, so that even if the same peak-to-peak voltage Vpp is applied, the current Iac running through the photoreceptor drum 5 is higher at the last stage of life (see the upper panel of FIG. 6). Therefore, the peak-to-peak voltage value Vpp, which is approximately at its optimal value at the initial stage of life, is not necessarily optimal at the last stage of life. More specifically, the optimal value is lower at the last stage of life than at the initial stage of life. The present inventors confirmed through experimentation that the optimal value decreased, for example, from 2150 V at the initial stage of life, to 1480 V at the last stage of life (see the lower panel of FIG. 6). Here, the optimal value is set, for example, by visual judgement, as described earlier, to an appropriate value at which high-quality image prints can be obtained.

Incidentally, in Japanese Laid-Open Patent Publication No. 2001-201920, the predetermined peak-to-peak voltage value Vpp1, which allows the discharge current value ΔIac (=f2(Vpp)−f1(Vpp)) to be at the constant value D, is derived, as described earlier. Here, assuming that the constant value D is 210, as shown in the lower panel of FIG. 6, the peak-to-peak voltage value Vpp1 is derived to be, for example, approximately equal to the optimal value (about 2150 V, indicated by an empty circle) at the initial stage of the life of the photoreceptor drum, but the peak-to-peak voltage value Vpp1 derived at the last stage of life is an inappropriate value (about 1740 V, indicated by an empty triangle) significantly higher than the optimal value (about 1480 V, indicated by an empty circle). Thus, in some cases, the approach in Japanese Laid-Open Patent Publication No. 2001-201920 fails to derive the predetermined peak-to-peak voltage value Vpp1 that approximates the optimal value in accordance with the life of the photoreceptor drum 5.

On the other hand, in the case of the image forming apparatus 1, the predetermined peak-to-peak voltage value Vpp1 is a peak-to-peak voltage value Vpp derived by the difference function where the amount of change (dΔIac/dVpp) of the difference value (discharge current amount) ΔIac per unit peak-to-peak voltage takes the predetermined value k. The discharge current amount ΔIac increases with the peak-to-peak voltage value Vpp regardless of whether the life of the photoreceptor drum 5 is at the initial stage or at the last stage. However, the amount of change (dΔIac/dVpp) starts increasing at a peak-to-peak voltage value Vpp which decreases toward the last stage of life.

In the present embodiment, the predetermined peak-to-peak voltage value Vpp1 is set such that the amount of change (dΔIac/dVpp) takes the predetermined value k, considering the tendency described above (S34 in FIG. 4), and therefore, if the predetermined value k is about 1/4, for example, the peak-to-peak voltage value Vpp1 derived at the initial stage of the life of the photoreceptor drum approximates the optimal value (about 2150 V), and the peak-to-peak voltage value Vpp1 derived at the last stage of life is about 1500 V, which approximates the optimal value (about 1480 V). That is, in the present embodiment, even at the last stage of life, the predetermined peak-to-peak voltage value Vpp1 derived differs only by 20 V from the optimal value obtained from actual measurements (see TABLE 3).

TABLE 3

TABLE 3: Comparison between Japanese Laid-Open Patent Publication No. 2001-201920 (JP Reference) and Present Invention

| | | Initial Stage of Life | Last Stage of Life |
|---|---|---|---|
| | Optimal Value | 2150 | 1480 |
| JP Reference (ΔIac set to constant value D) | ΔIac | 210 | 210 |
| | Derived Vpp1 | 2150 | 1740 |
| | Derived Vpp1 minus Optimal Value | 0 | 260 |
| Embodiment (dΔIac/dVpp set to predetermined value k) | ΔIac | 210 | 130 |
| | Derived Vpp1 | 2150 | 1500 |
| | Derived Vpp1 minus Optimal Value | 0 | 20 |

Figure 7:
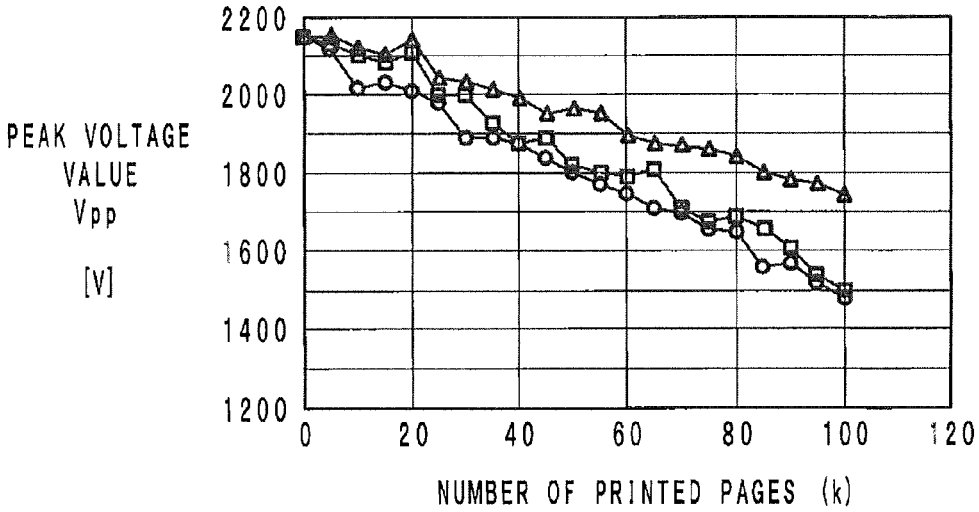
FIG. 7 is a graph showing changes in peak-to-peak voltage value over the number of printed pages (for derived values in the embodiment as well as derived values and optimal values in Japanese Laid-Open Patent Publication No. 2001-201920)

Furthermore, the present inventors measured changes in the peak-to-peak voltage value Vpp over the number of printed pages. The results are shown in FIG. 7. In FIG. 7, empty circles represent optimal values obtained, for example, by visual judgement, empty squares represent predetermined peak-to-peak voltage values Vpp1 obtained in the present embodiment, and empty triangles represent predetermined peak-to-peak voltage values Vpp1 obtained by Japanese Laid-Open Patent Publication No. 2001-201920.

As described earlier, the optimal value decreases as the number of printed pages increases. This can be said for both the present embodiment and Japanese Laid-Open Patent Publication No. 2001-201920. However, the more the number of printed pages increases, the further the peak-to-peak voltage value Vpp of Japanese Laid-Open Patent Publication No. 2001-201920 diverges from the optimal value. On the other hand, the predetermined peak-to-peak voltage value Vpp1 of the present embodiment follows the optimal value in close correlation regardless of the number of printed pages.

The present inventors further measured the amount of wear and tear on the photoreceptor drum 5 after having printed 100,000 pages by the image forming apparatus for each of Japanese Laid-Open Patent Publication No. 2001-201920 and the present embodiment. Here, the design target for the amount of wear and tear after printing 100,000 pages is assumed to be 15 μm. The measurement results are an amount of wear and tear of 14.8 μm for the image forming apparatus of Japanese Laid-Open Patent Publication No. 2001-201920 and an amount of wear and tear of 11.2 μm for the image forming apparatus 1 of the present embodiment (see TABLE 4 below).

TABLE 4

TABLE 4: Amount of Wear and Tear after Printing 100k Pages

| | Amount of Wear and Tear after Printing 100k Pages |
|---|---|
| Design Target | 15 μm |
| Embodiment (dΔIac/dVpp set to predetermined value k) | 11.2 μm |
| JP Reference (ΔIac set to constant value D) | 14.8 μm |

As described above, by deciding the predetermined peak-to-peak voltage value Vpp1 such that the amount of change (dΔIac/dVpp) takes the predetermined value k regardless of the number of printed pages, it is rendered possible to provide an image forming apparatus capable of inhibiting the life of the photoreceptor drum 5 from being shortened.

Section 5: First Modification

As is well-known, the charging section 6 is resistant to discharge in a low temperature environment, and in the case where the internal temperature St is low, the approximation functions f1(Vpp) and f2(Vpp) shift to the constant-current side compared to the case where the internal temperature St is high, and further, the amount of increase in the current Iac per unit peak-to-peak voltage decreases. The same can be said of the difference function ΔIac. Moreover, it is also known that the optimal value shifts to the high-voltage side.

Figure 8:
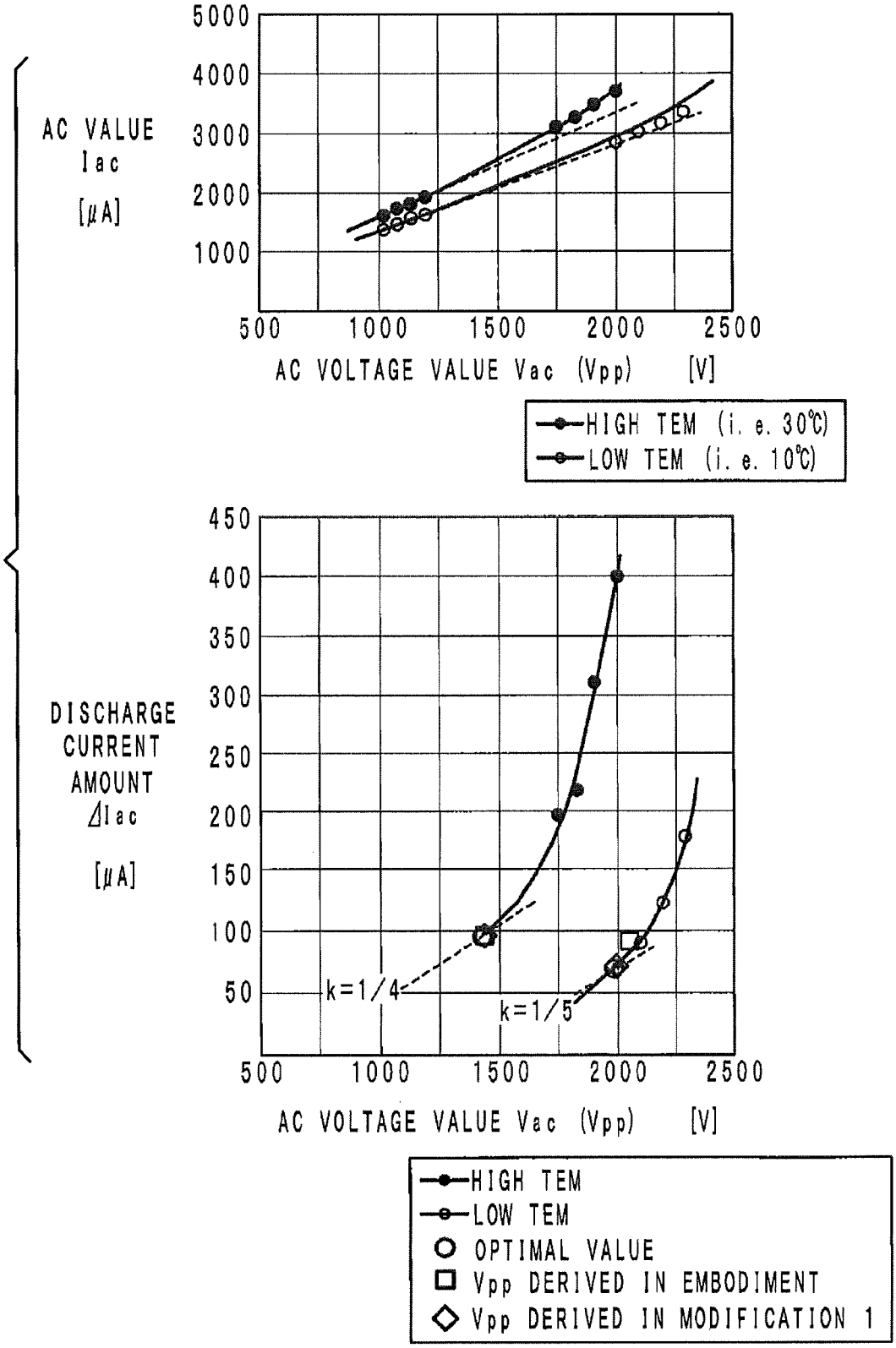
FIG. 8 provides graphs showing changes in optimal peak-to-peak voltage value depending on internal temperatures.

Assume the case as shown in the lower panel of FIG. 8 where the optimal value (represented by an empty circle) is about 1260 V when the internal temperature St is high (e.g., 30° C.). Also assume that the above embodiment is optimized for high temperature, and the predetermined value k is set at about 1/4 such that a reference peak-to-peak voltage value Vpp1 of about 1275 V (represented by an empty square) is derived at high temperature. However, at a low temperature of, for example, 10° C., the optimal value (represented by an empty circle) is about 1480 V, and when the predetermined value k is set at about 1/4, the predetermined peak-to-peak voltage value Vpp1 (about 1603 V, indicated by an empty square) derived in the embodiment is higher than the optimal value by about 123 V. Application of such a high predetermined peak-to-peak voltage value Vpp1 to the charging section 6 accelerates wear and tear on the photoreceptor drum 5.

In view of the above, a first modification aims to provide an image forming apparatus capable of setting the predetermined value k appropriately in accordance with the internal temperature St.

Figure 9:
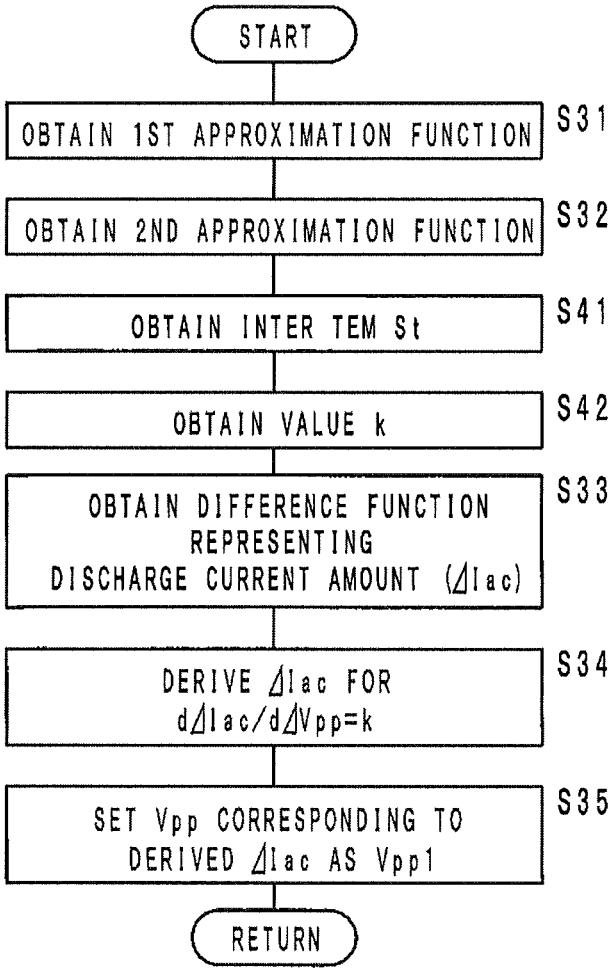
FIG. 9 is a flowchart showing in detail the processing at S215 in FIG. 3B according to a first modification.

The first modification is different from the embodiment in that the procedure in FIG. 9 is carried out in place of the procedure in FIG. 4. There is no other difference, therefore, components and process steps in the present modification that correspond to those in the embodiment are denoted by the same reference characters, and any descriptions thereof will be omitted herein.

In FIG. 9, after S32 (described in detail earlier), the CPU 112 obtains the current internal temperature St from the environment sensing section 13 (S41). Next, the CPU 112 obtains a predetermined value k corresponding to the internal temperature St obtained at S41, from a predetermined-value table T1 pre-stored in the ROM 111 or the NVRAM 114 (S42). The table T1 lists a predetermined value k for each temperature range, as shown in TABLE 5 below. The present modification employs the following three temperature ranges: less than 15° C.; from 15° C. to less than 25° C.; and 25° C. and higher. The predetermined values k assigned to the ranges of less than 15° C., from 15° C. to less than 25° C., and 25° C. and higher are respectively 1/5, 1/4.5, and 1/4. These predetermined values k are appropriately obtained in advance, for example, through experimentation in the course of the design and development of the image forming apparatus 1, such that the reference peak-to-peak voltage value Vpp1 approximately the same as the optimal value for their corresponding temperature range can be derived.

TABLE 5

TABLE 5: Predetermined Value k for Each Temperature Range

| | Temperature Range | | |
|---|---|---|---|
| | <15° C. | <25° C. 15° C.≤ | 25° C.≤ |
| Predetermined Value k | 1/5 | 1/4.5 | 1/4 |

Next, the CPU 112 performs step S33 (described in detail earlier) using the predetermined value k obtained at S42.

The above processing renders it possible to provide an image forming apparatus 1 capable of setting the predetermined value k appropriately in accordance with the internal temperature St. More specifically, as can be appreciated from measurement results by the present inventors, as shown in TABLE 6 below, the optimal value is about 1425 V when the internal temperature St is 30° C. The present inventors optimize the above embodiment for the internal temperature St of 30° C., and set the predetermined value k at 1/4. Consequently, in the case of the image forming apparatus 1 according to the embodiment, a reference peak-to-peak voltage value Vpp1 approximating the optimal value for 30° C. is derived to be about 1434 V. However, for example, at 10° C., the optimal value is about 1960 V, and as for the image forming apparatus 1 according to the embodiment, where the predetermined value k is about 1/4, the predetermined peak-to-peak voltage value Vpp1 is derived to be about 2066 V, which is higher than the optimal value by about 106 V. Therefore, in the present modification, the predetermined value k is set at 1/5 for the temperature range of less than 15° C., and as for the image forming apparatus 1 according to the present modification, a reference peak-to-peak voltage Vpp1 better approximating the optimal value for 10° C. is derived to be about 1981 V.

TABLE 6

TABLE 6: Comparison between Cases of Different Internal Temperatures

| | | Internal Temperature St | |
|---|---|---|---|
| | | 30° C. | 10° C. |
| | Optimal ΔIac | 92 | 68 |
| | Optimal Value | 1425 | 1960 |
| Embodiment (dΔIac/dVpp set to | Predetermined Value k | 1/4 | 1/4 |
| | Derived ΔIac | 94 | 91 |

TABLE 6-continued

TABLE 6: Comparison between Cases of Different Internal Temperatures

| | | Internal Temperature St | |
|---|---|---|---|
| | | 30° C. | 10° C. |
| predetermined value k (constant regardless of temperature)) | Derived Vpp1 | 1434 | 2066 |
| | Derived Vpp1 minus Optimal Vpp | 9 | 106 |
| Modification 1 (dΔIac/dVpp set to predetermined value k (variable depending on temperature)) | Predetermined Value k | 1/4 | 1/5 |
| | Derived ΔIac | 94 | 73 |
| | Derived Vpp1 | 1434 | 1981 |
| | Derived Vpp1 minus Optimal Vpp | 9 | 21 |

Furthermore, the present inventors carried out printing in accordance with the approach of Japanese Laid-Open Patent Publication No. 2001-201920, the above embodiment, and the first modification under conditions (for durability testing) as specified below, and thereafter, the present inventors actually measured the amounts of wear and tear on photoreceptor drums 5 and also visually inspected print image quality; the measurement and inspection results are shown in TABLE 7 below for comparison. The conditions for the durability testing are as follows:

size of printing medium M: A4 landscape;

printed toner image: test chart with 5% image coverage; and number of printed pages: 100,000.

TABLE 7

TABLE 7: Comparison among JP Reference, Embodiment and Modification 1

| | | Amount of Wear and Tear | | | Image Quality | | |
|---|---|---|---|---|---|---|---|
| | | 10° C. | 20° C. | 30° C. | 10° C. | 20° C. | 30° C. |
| JP Reference | Optimized for 30° C. | NG | Ave. | G | G | G | G |
| | Optimized for 20° C. | NG | G | NG | G | G | G |
| | Optimized for 10° C. | G | Ave. | NG | G | Ave. | NG |
| Embodiment | dΔIac/dVpp Set to Predetermined Value k | G | G | Excel. | G | G | G |
| Modification 1 | Predetermined Value k Variable depending on Temperature | Excel. | Excel. | Excel. | G | G | G |

In TABLE 7, for evaluation of the amount of wear and tear, "Excel." is intended to mean that the amount of wear and tear is less than 10 μm for the design target of 15 μm. "G", "Ave.", and "NG" are intended to mean that the amount of wear and tear is from 10 μm to less than 14 μm, from 14 μm to less than 15 μm, or 15 μn and higher, respectively, for the design target of 15 μm. Moreover, for evaluation of image quality, "G" is intended to mean no image defect due to charging failure, "Ave." is intended to mean a partial image defect, and "NG" is intended to mean an entire image defect.

The present inventors initially prepared the image forming apparatus of Japanese Laid-Open Patent Publication No. 2001-201920, for which the predetermined value D was set to an optimum for 30° C. Thereafter, the image forming apparatus was subjected to durability testing with the above conditions and the internal temperature St being at 10° C. In this case, the predetermined peak-to-peak voltage value Vpp1 is higher than the optimal value, so that the amount of wear and tear on the photoreceptor drum 5 after the testing is greater than 15 μm, i.e., greater than the design target (15 μm), and therefore, the amount of wear and tear is evaluated as "No Good (NG)". Note that at 20° C., the amount of wear and tear after the durability testing is from 14 μm to less than 15 μm, and therefore is estimated as "Average (Ave.)". In addition, at 30° C., the amount of wear and tear after the durability testing is less than 14 μm, and therefore is estimated as "Good (G)". Moreover, in this testing, no reduction in image quality due to charging failure was visually confirmed regardless of the temperature, and therefore, image quality is evaluated as "G" for all temperature conditions.

Further, the present inventors assessed the amount of wear and tear and image quality for the image forming apparatus of Japanese Laid-Open Patent Publication No. 2001-201920, for which the predetermined value D was set to an optimum for 20° C., after carrying out the durability testing under the condition of the internal temperature St of 10° C. In this case also, the predetermined peak-to-peak voltage value Vpp1 derived is high, and therefore, the amount of wear and tear is evaluated as "NG". At 30° C., the predetermined peak-to-peak voltage value Vpp1 derived is low, and charging failure occurs. Accordingly, image quality is evaluated as "NG". Moreover, due to charging failure, toner is supplied to a non-image area as well, so that wear and tear is accelerated, resulting in an evaluation "NG" for the amount of wear and tear.

Still further, the present inventors assessed the amount of wear and tear and image quality for the image forming apparatus of Japanese Laid-Open Patent Publication No. 2001-201920, for which the predetermined value D was set to an optimum for 10° C., after carrying out the durability testing under the condition of the internal temperature St of 30° C. For the same reasons as above, both the amount of wear and tear and image quality are evaluated as "NG". Moreover, at 20° C., the amount of wear and tear and image quality are evaluated as "Ave.".

As described above, in the case of the image forming apparatus of Japanese Laid-Open Patent Publication No. 2001-201920, the photoreceptor drum 5 is prone to wear and tear due to repeated printing. Moreover, depending on the internal temperature, the amount of wear and tear on the photoreceptor drum 5 significantly increases, and image quality is affected as well.

On the other hand, in the case of the image forming apparatus 1 according to the embodiment, for example, even if the image forming apparatus 1 is optimized for 30° C., the discharge current amount ΔIac is derived such that the derivative (dΔIac/dVpp) takes the predetermined value k, and therefore, the predetermined peak-to-peak voltage value Vpp1 follows the optimal value. As a result, even when the durability testing is carried out with the internal temperature St of either 10° C. or 20° C., both the amount of wear and tear and image quality are evaluated as "G".

Furthermore, in the case of the image forming apparatus 1 according to the first modification, the predetermined peak-to-peak voltage value Vpp1 is derived so as to follow variations in the optimal value due to temperature changes, so that the amount of wear and tear is evaluated as "Excellent (Excel.)", and the image quality is evaluated as "G".

Section 6: Second Modification

At S29 in FIG. 3B, in some cases, an abnormal alternating-current value Iac due to noise might be detected. Consequently, an unexpected discharge current amount ΔIac and therefore an unexpected predetermined peak-to-peak voltage value Vpp1 could be derived at S34 and S35 in FIG. 4. Specifically, when the reference peak voltage value Vpp1 is inappropriately high, wear and tear on the photoreceptor drum 5 is accelerated, whereas, when the reference peak voltage value Vpp1 is inappropriately low, print image quality is affected.

Figure 10:
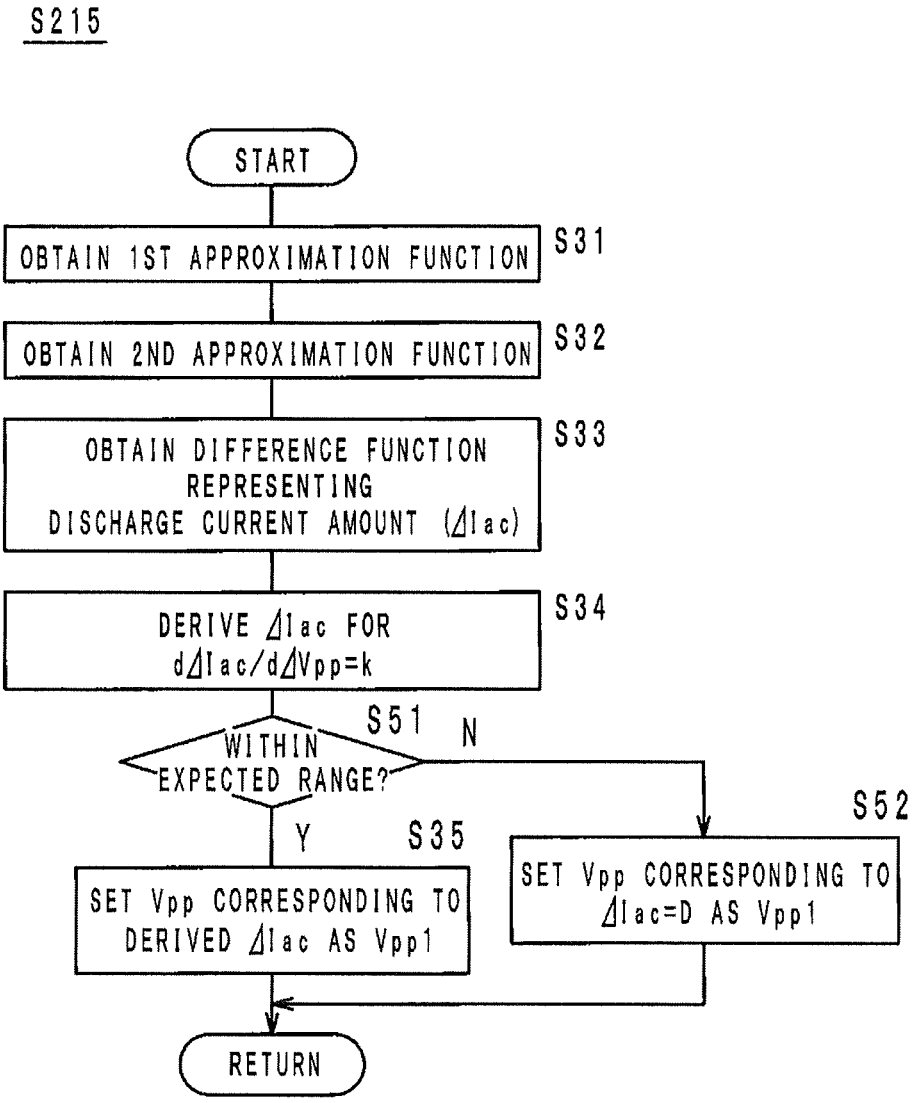
FIG. 10 is a flowchart showing in detail the processing at S215 in FIG. 3B according to a second modification.

Therefore, in the present modification, the procedure shown in FIG. 10 is performed in place of the procedure shown in FIG. 4. As shown in FIG. 10, between the aforementioned steps S34 and S35, the CPU 112 determines whether the discharge current amount ΔIac derived at S34 falls out of an expected range (S51). In the present modification, the discharge current amount ΔIac is determined to fall out of the range, for example, when the discharge current amount ΔIac is either greater than or equal to a predicted upper limit (e.g., 250 μA) or less than or equal to a predicted lower limit (e.g., 100 μA).

If the determination at S51 is "N", the CPU 112 derives as predetermined peak-to-peak voltage value Vpp1 a peak-to-peak voltage value Vpp for which the discharge current amount ΔIac in the difference function ΔIac takes a predetermined constant value D (S52).

In contrast to the above, if the determination at S51 is "Y", the CPU 112 performs step S35. Upon completion of S35, or upon completion of S52 in the case where the determination is "N", the CPU 112 exits the procedure in FIG. 10, and performs step S216 in FIG. 3B. At this time, the predetermined peak-to-peak voltage value Vpp1 derived at either S35 or S52 is used.

Section 7: Supplementary

In the above embodiment, the image forming apparatus 1 has been described as including the current sensing section 12 for each color. However, this is not limiting, and the current sensing section 12 may be provided either for only one charging section 6 for a specific representative color or for each of two or three charging sections 6 for specific representative colors.

Furthermore, in the embodiment, the difference function f2(Vpp)−f1(Vpp) is employed. However, this is not limiting, and the difference function f1(Vpp)−f2(Vpp) may be employed. Note that in this case, the amount of change in the difference function is a decrement.

Although the present invention has been described in connection with the preferred embodiment above, it is to be noted that various changes and modifications are possible to those who are skilled in the art. Such changes and modifications are to be understood as being within the scope of the invention.

What is claimed is:

1. An image forming apparatus for printing an image on a medium being fed therethrough, comprising:

an image carrier;

a charging section disposed in proximity to the image carrier;

a power supply applying a first charged voltage to the charging section during a predetermined process and also applying a plurality of second charged voltages sequentially to the charging section in obtaining a predetermined peak-to-peak voltage value, wherein the first charged voltage includes an alternating-current voltage having the predetermined peak-to-peak voltage value, each of the second charged voltages includes an alternating-current voltage, and the alternating-current voltage of the second charged voltage has a peak-to-peak voltage value varying between a forward discharge range where a charge transfer occurs only from the charging section to the image carrier and a back discharge range where a bidirectional charge transfer occurs between the image carrier and the charging section;

a current sensing section sensing a value of an alternating-current running through the charging section upon application of each of the second charged voltages; and a control section deriving a first approximation function and a second approximation function on the basis of the alternating-current values sensed by the current sensing section and setting a peak-to-peak voltage value as the predetermined peak-to-peak voltage through a difference function representing a difference value between the derived first approximation function and the derived second approximation function, wherein the first approximation function and the second approximation function represent alternating-current values relative to peak-to-peak voltage values in the forward discharge range and the back discharge range, and the peak-to-peak voltage value being set as the predetermined peak-to-peak voltage is a value for which an amount of change of the difference value per unit peak-to-peak voltage in the difference function takes a predetermined value, wherein the predetermined value is constant regardless of the number of printed pages.

2. The image forming apparatus according to claim 1, wherein the control section approximates the alternating-current values relative to peak-to-peak voltage values in the forward discharge range and the back discharge range by a straight line and a curve.

3. The image forming apparatus according to claim 1, further comprising an environment sensing section sensing a temperature inside the image forming apparatus, wherein, the control section obtains the predetermined value in accordance with the temperature sensed by the environment sensing section, and the control section sets a peak-to-peak voltage value for which the amount of change in the difference function takes the obtained value, as the predetermined peak-to-peak voltage.

4. An image forming apparatus for printing an image on a medium being fed therethrough, comprising:

an image carrier;

a charging section disposed in proximity to the image carrier;

a power supply applying a first charged voltage to the charging section during a predetermined process and also applying a plurality of second charged voltages sequentially to the charging section in obtaining a predetermined peak-to-peak voltage value, wherein the first charged voltage includes an alternating-current voltage having the predetermined peak-to-peak voltage value, each of the second charged voltages includes an alternating-current voltage, and the alternating-current voltage of the second charged voltage has a peak-to-peak voltage value varying between a forward discharge range where a charge transfer occurs only from the charging section to the image carrier and a back discharge range where a bidirectional charge transfer occurs between the image carrier and the charging section;

a current sensing section sensing a value of an alternating-current running through the charging section upon application of each of the second charged voltages; and a control section deriving a first approximation function and a second approximation function on the basis of the alternating-current values sensed by the current sensing section and setting a peak-to-peak voltage value as the predetermined peak-to-peak voltage through a difference function representing a difference value between the derived first approximation function and the derived second approximation function, wherein the first approximation function and the second approximation function represent alternating-current values relative to peak-to-peak voltage values in the forward discharge range and the back discharge range, and the peak-to-peak voltage value being set as the predetermined peak-to-peak voltage is a value for which an amount of change of the difference value per unit peak-to-peak voltage in the difference function takes a predetermined value, wherein, the control section obtains the difference value for which the amount of change per unit peak-to-peak voltage in the difference function takes the predetermined value, and when the obtained difference value falls out of an expected range, the control section sets a peak-to-peak voltage value for which the amount of change takes a predetermined constant value, as the predetermined peak-to-peak voltage.

5. A method for printing an image on a medium being fed through an image forming apparatus comprising an image carrier and a charging section disposed in proximity to the image carrier, said method comprising:

a voltage applying step of applying a first charged voltage to the charging section during a predetermined process and also applying a plurality of second charged voltages sequentially to the charging section in obtaining a predetermined peak-to-peak voltage value, wherein the first charged voltage includes an alternating-current voltage having the predetermined peak-to-peak voltage value, each of the second charged voltages includes an alternating-current voltage, and the alternating-current voltage of the second charged voltage has a peak-to-peak voltage value varying between a forward discharge range where a charge transfer occurs only from the charging section to the image carrier and a back discharge range where a bidirectional charge transfer occurs between the image carrier and the charging section;

a sensing step of sensing an alternating-current running through the charging section upon application of each of the second charged voltages and sending a current value; and a deriving step of deriving a first approximation function and a second approximation function on the basis of the alternating-current values sensed by the current sensing section and setting a peak-to-peak voltage value as the predetermined peak-to-peak voltage through a difference function representing a difference value between the derived first approximation function and the derived second approximation function, wherein the first approximation function and the second approximation function represent alternating-current values relative to peak-to-peak voltage values in the forward discharge range and the back discharge range, and the peak-to-peak voltage value being set as the predetermined peak-to-peak voltage is a value for which an amount of change of the difference value per unit peak-to-peak voltage in the difference function takes a predetermined value, wherein the predetermined value is constant regardless of the number of printed pages.

6. The method according to claim 5, wherein at the deriving step, the alternating-current values relative to peak-to-peak voltage values in the forward discharge range and the back discharge range are approximated by a straight line and a curve.

7. The method according to claim 5, further comprising a sensing step of sensing a temperature inside the image forming apparatus, wherein, at the deriving step, the predetermined value is obtained in accordance with the temperature sensed at the sensing step, and at the deriving step, a peak-to-peak voltage value for which the amount of change in the difference function takes the obtained value is set as the predetermined peak-to-peak voltage.

8. A method for printing an image on a medium being fed through an image forming apparatus comprising an image carrier and a charging section disposed in proximity to the image carrier, said method comprising:

a voltage applying step of applying a first charged voltage to the charging section during a predetermined process and also applying a plurality of second charged voltages sequentially to the charging section in obtaining a predetermined peak-to-peak voltage value, wherein the first charged voltage includes an alternating-current voltage having the predetermined peak-to-peak voltage value, each of the second charged voltages includes an alternating-current voltage, and the alternating-current voltage of the second charged voltage has a peak-to-peak voltage value varying between a forward discharge range where a charge transfer occurs only from the charging section to the image carrier and a back discharge range where a bidirectional charge transfer occurs between the image carrier and the charging section;

a sensing step of sensing an alternating-current running through the charging section upon application of each of the second charged voltages and sending a current value; and a deriving step of deriving a first approximation function and a second approximation function on the basis of the alternating-current values sensed by the current sensing section and setting a peak-to-peak voltage value as the predetermined peak-to-peak voltage through a difference function representing a difference value between the derived first approximation function and the derived second approximation function, wherein the first approximation function and the second approximation function represent alternating-current values relative to peak-to-peak voltage values in the forward discharge range and the back discharge range, and the peak-to-peak voltage value being set as the predetermined peak-to-peak voltage is a value for which an amount of change of the difference value per unit peak-to-peak voltage in the difference function takes a predetermined value, wherein, at the deriving step, the difference value for which the amount of change per unit peak-to-peak voltage in the difference function takes the predetermined value is obtained, and when the obtained difference value falls out of an expected range, at the deriving step, a peak-to-peak voltage value for which the amount of change takes a predetermined constant value is set as the predetermined peak-to-peak voltage.

* * * * *